US011753850B2

(12) United States Patent
Chen

(10) Patent No.: US 11,753,850 B2
(45) Date of Patent: Sep. 12, 2023

(54) CONTROL STRUCTURE OF DOOR LOCK

(71) Applicant: Jeff Chen, Chiayi (TW)

(72) Inventor: Jeff Chen, Chiayi (TW)

( * ) Notice: Subject to any disclaimer, the term of this patent is extended or adjusted under 35 U.S.C. 154(b) by 0 days.

(21) Appl. No.: 17/515,704

(22) Filed: Nov. 1, 2021

(65) Prior Publication Data

US 2023/0137238 A1 May 4, 2023

(51) Int. Cl.

| | |
|---|---|
| ***E05B 47/00*** | (2006.01) |
| ***E05B 55/00*** | (2006.01) |
| ***E05B 47/02*** | (2006.01) |
| ***E05B 63/08*** | (2006.01) |
| ***E05B 63/00*** | (2006.01) |

(52) U.S. Cl.

CPC ..... *E05B 47/0012* (2013.01); *E05B 47/026* (2013.01); *E05B 55/005* (2013.01); *E05B 63/08* (2013.01); *E05B 63/0056* (2013.01); *E05B 2047/002* (2013.01); *E05B 2047/0026* (2013.01)

(58) Field of Classification Search

CPC .. E05B 47/00; E05B 47/0001; E05B 47/0012; E05B 47/026; E05B 2047/002; E05B 2047/0022; E05B 2047/0024–0028; E05B 2047/003; E05B 2047/0031; E05B 2047/0032; E05B 2047/0033; E05B 2047/0034; E05B 55/00; E05B 55/005; E05B 63/00; E05B 63/0056; E05B 63/06; E05B 15/00; E05B 15/0085

USPC ..... 70/277

See application file for complete search history.

(56) References Cited

U.S. PATENT DOCUMENTS

2004/0040352 A1* 3/2004 Yu ..... E05B 47/068 70/107
2004/0040353 A1* 3/2004 Yu ..... E05B 47/068 70/277

FOREIGN PATENT DOCUMENTS

AU 2010202816 A1 * 7/2010 ..... E05B 17/0058
CN 105484580 A * 4/2016
KR 20180106707 A * 1/2018

* cited by examiner

*Primary Examiner* — Nathan Cumar
(74) *Attorney, Agent, or Firm* — Karin L. Williams; Alan D. Kamrath; Mayer & Williams PC

(57) ABSTRACT

A control structure of a door lock contains: a body, a slide plate, a clutch assembly, a head, a clutch assembly, and a guider. The body includes a chamber, a receiving groove, a motor, a drive gear, a trench, and a resilient element. The slide plate includes a holder, a trough, a lever, a lock cylinder, and a first connection orifice. The clutch assembly is received in the slide plate and includes a first annular ring, a second annular ring, and a third annular ring. The second annular ring includes two first cutouts, two second cutouts, and two recessed portions. The head includes a defining groove, a second connection orifice, and two bosses. The guider rotatably is fixed in the chamber and includes a space and at least two spiral indentations formed on an outer wall of the guider.

3 Claims, 7 Drawing Sheets

A-A

B-B

C-C

D-D

E-E

F-F

CONTROL STRUCTURE OF DOOR LOCK

FIELD OF THE INVENTION

The present invention relates to a control structure of a door lock which actuates the head to extend outward or retract inward to lock or unlock the two screw bolts by way of the guider, the clutch assembly and the resilient element.

BACKGROUND OF THE INVENTION

A conventional door lock contains a first connection part and a second connection part which is connected with the first connection part. However, the door lock is operated poorly and deforms easily after a period of using time.

The present invention has arisen to mitigate and/or obviate the afore-described disadvantages.

SUMMARY OF THE INVENTION

The primary aspect of the present invention is to provide a control structure of a door lock which actuates the head to extend outward or retract inward to lock or unlock the two screw bolts by way of the guider, the clutch assembly and the resilient element.

To achieve the above-mentioned aspect, a control structure of a door lock provided by the present invention contains a body, a slide plate, a clutch assembly, a head, a clutch assembly, and a guider.

The body includes a chamber defined in the body, a receiving groove formed in the chamber, a motor partially accommodated in the receiving groove, a drive gear fixed on a front end of the drive motor, a trench defined on a predetermined position of the body and corresponding to the receiving groove, and a resilient element retained in the trench.

The slide plate is accommodated in the body and includes a holder formed on a first end of the slide plate, a trough defined on the holder and configured to receive a rotation element, a lever extending from a top of the rotation element, received in the trough, and configured to drive the slide plate to move with respect to the body, a lock cylinder extending from the rotation element into the body, and a first connection orifice defined on a second end of the slide plate.

The clutch assembly is hollow, received in the slide plate and located beside the motor. The clutch assembly includes a first annular ring, a second annular ring, and a third annular ring. The first annular ring has two notches defined on a top and a bottom thereof, two wings extending from two sides of the first annular ring to the second annular ring, and a toothed portion formed around an inner wall of the first annular ring and meshing with the drive gear of the motor.

The second annular ring is located beside the first annular ring, and the second annular ring includes two first cutouts defined on a top and a bottom of the second annular ring, two second cutouts formed on two sides of the second annular ring, two recessed portions defined on the second cutouts and facing the first annular ring so as to engage with the two wings.

The third annular ring is located beside the second annular element and abuts against the resilient element. The third annular ring includes two actuation portions extending to the second annular element and engaged with the two first cutouts of the second annular ring and the first annular ring.

The head includes a defining groove formed on a side of the head, and the head includes a second connection orifice communicating with the defining groove and configured to partially receive the first end of the slide plate. The second connection orifice is aligned with the first connection orifice so that a coupling element is screwed with the first connection orifice and the second connection orifice to fix the head on the first end of slide plate, and the head further includes two bosses formed on two predetermined positions of an outer wall thereof.

The guider rotatably is fixed in the chamber of the body and includes a space defined in the guider so as to guide the head to move into or remove from the guider, and the guider includes at least two spiral indentations formed on an outer wall of the guider. The at least two spiral indentations are in communication with the space and are configured to movably engage with the two bosses, such that when the head moves forward or backward, the two bosses drive the two spiral indentations of the guider to rotate clockwise or counterclockwise, and the guider further includes two extensions engaged with the two recessed portions of the second annular ring.

DETAILED DESCRIPTION OF THE PREFERRED EMBODIMENTS

Figure 1:
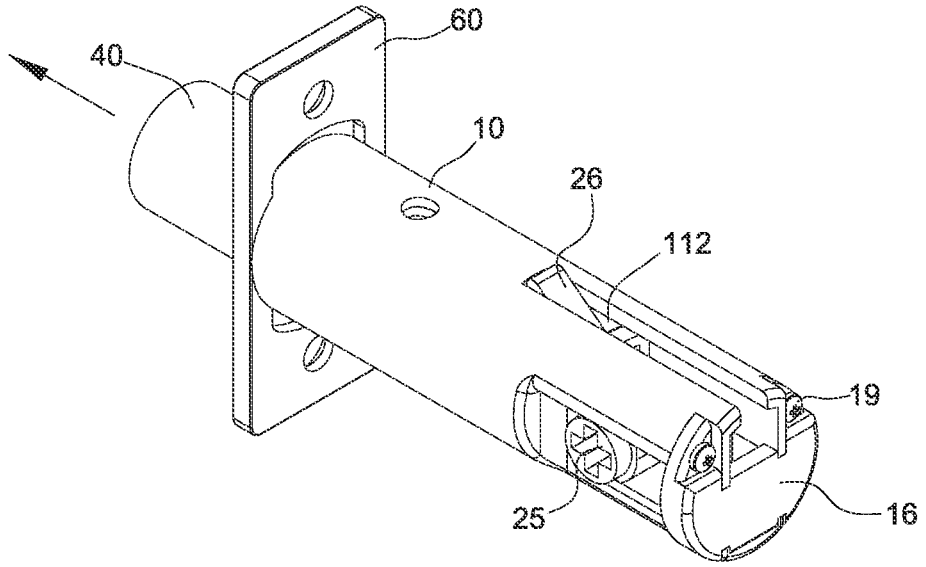
FIG. 1 is a perspective view showing the operation of a control structure of a door lock according to a preferred embodiment of the present invention.
Figure 2:
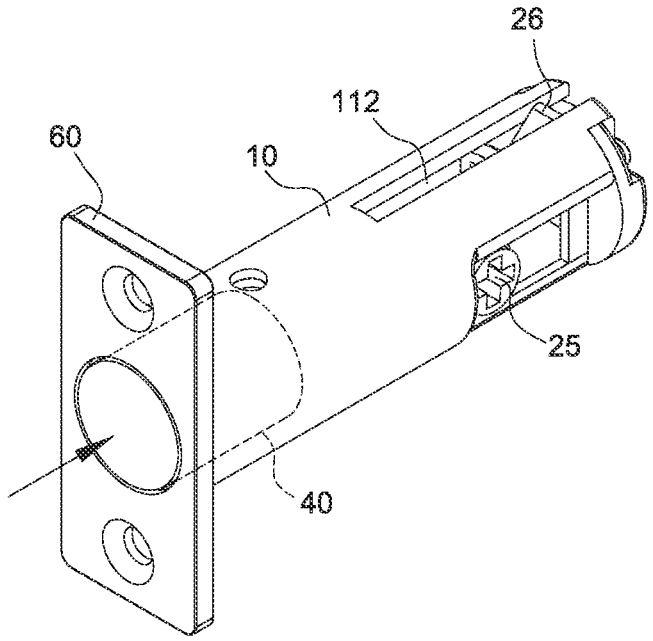
FIG. 2 is another perspective view showing the operation of the control structure of the door lock according to the preferred embodiment of the present invention.
Figure 3:
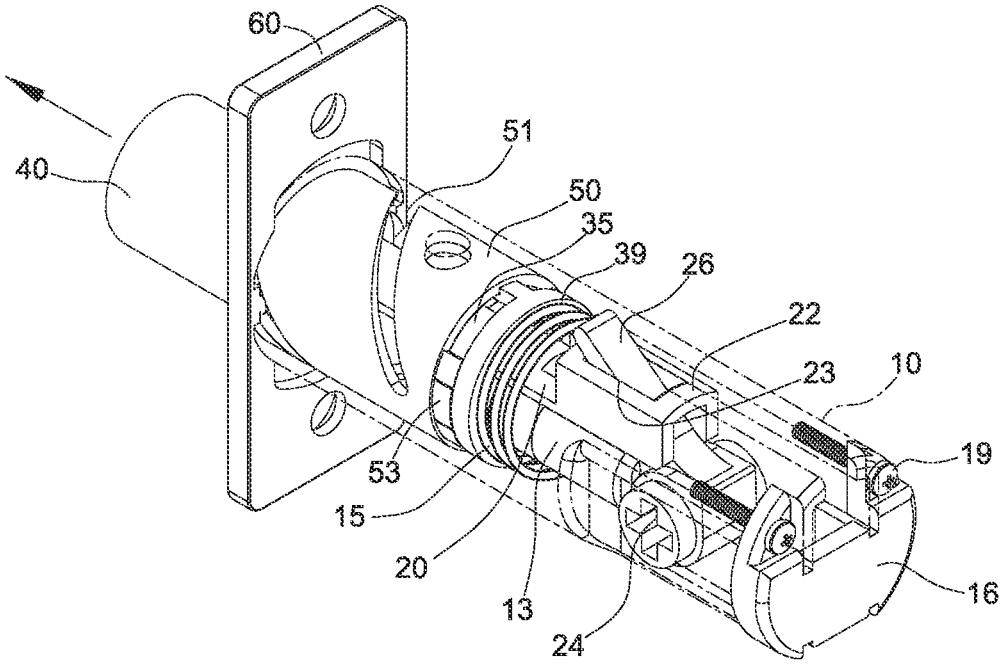
FIG. 3 is also another perspective view showing the operation of the control structure of the door lock according to the preferred embodiment of the present invention.
Figure 4:
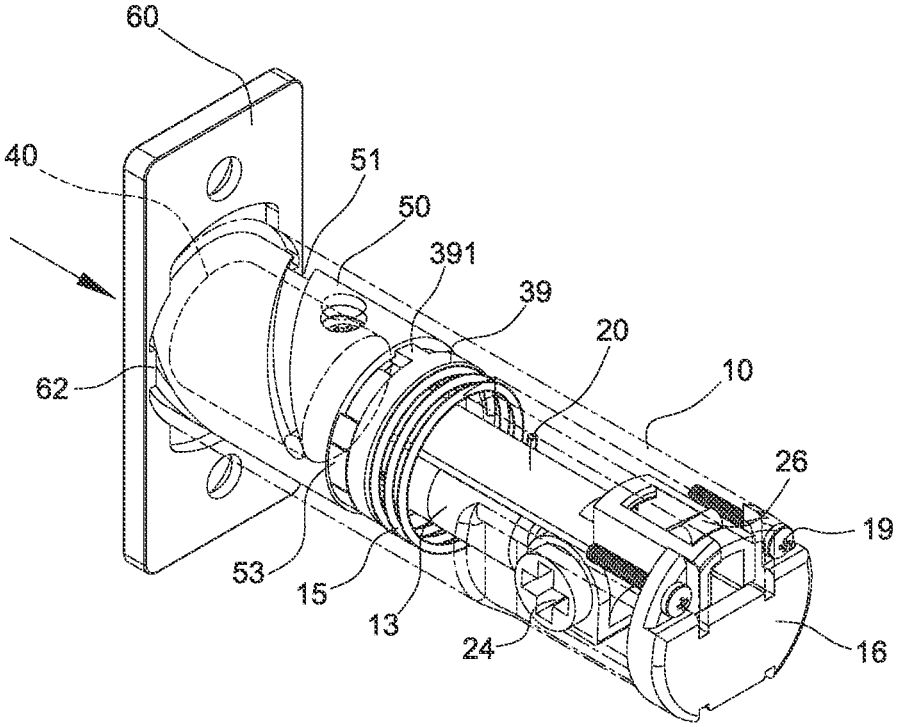
FIG. 4 is still another perspective view showing the operation of the control structure of the door lock according to the preferred embodiment of the present invention.
Figure 5:
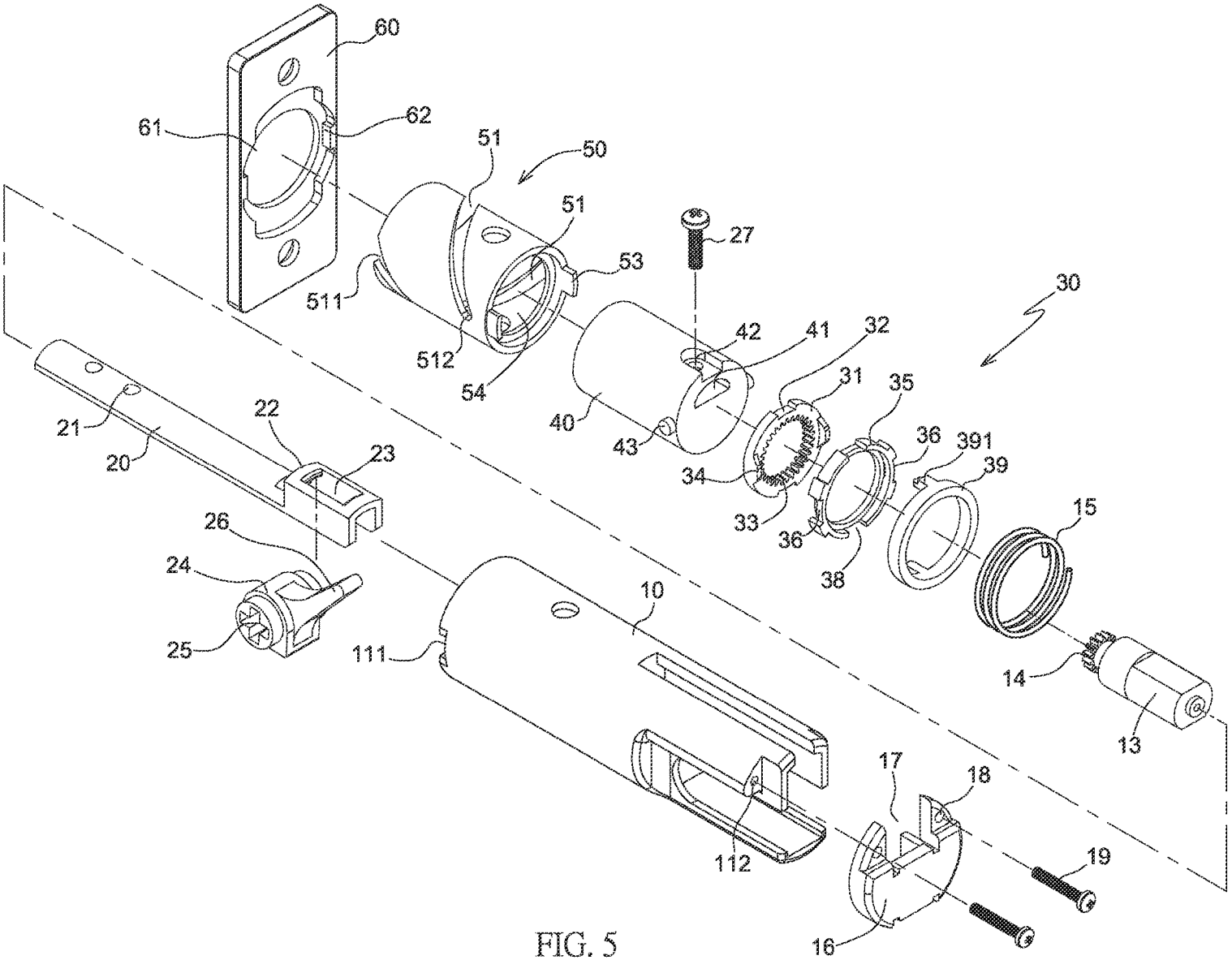
FIG. 5 is a perspective view showing the exploded components of the control structure of the door lock according to the preferred embodiment of the present invention.
Figure 6:
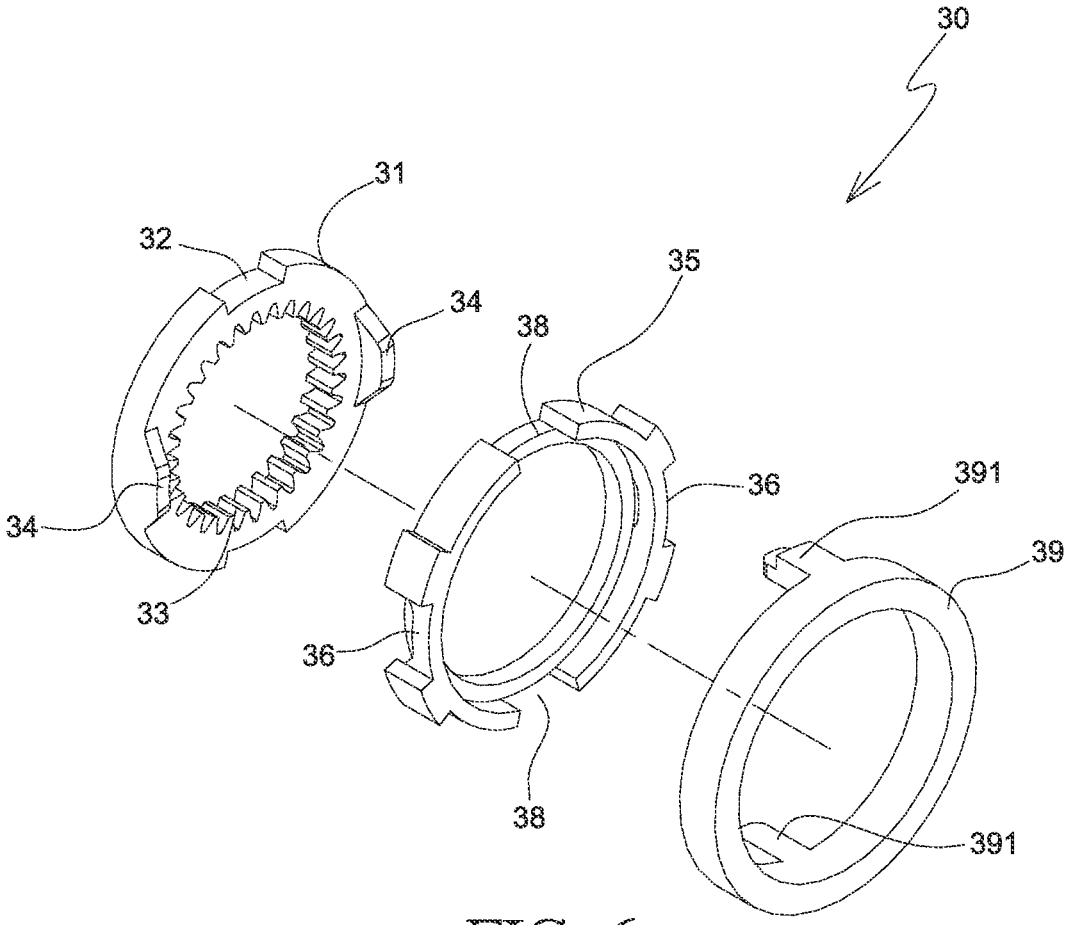
FIG. 6 is a perspective view showing the exploded components of a part of the control structure of the door lock according to the preferred embodiment of the present invention.
Figure 7:
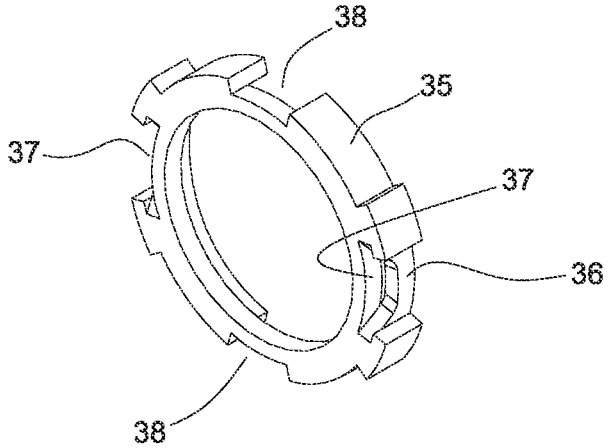
FIG. 7 is a perspective view showing the assembly of a part of the control structure of the door lock according to the preferred embodiment of the present invention.
Figure 8:
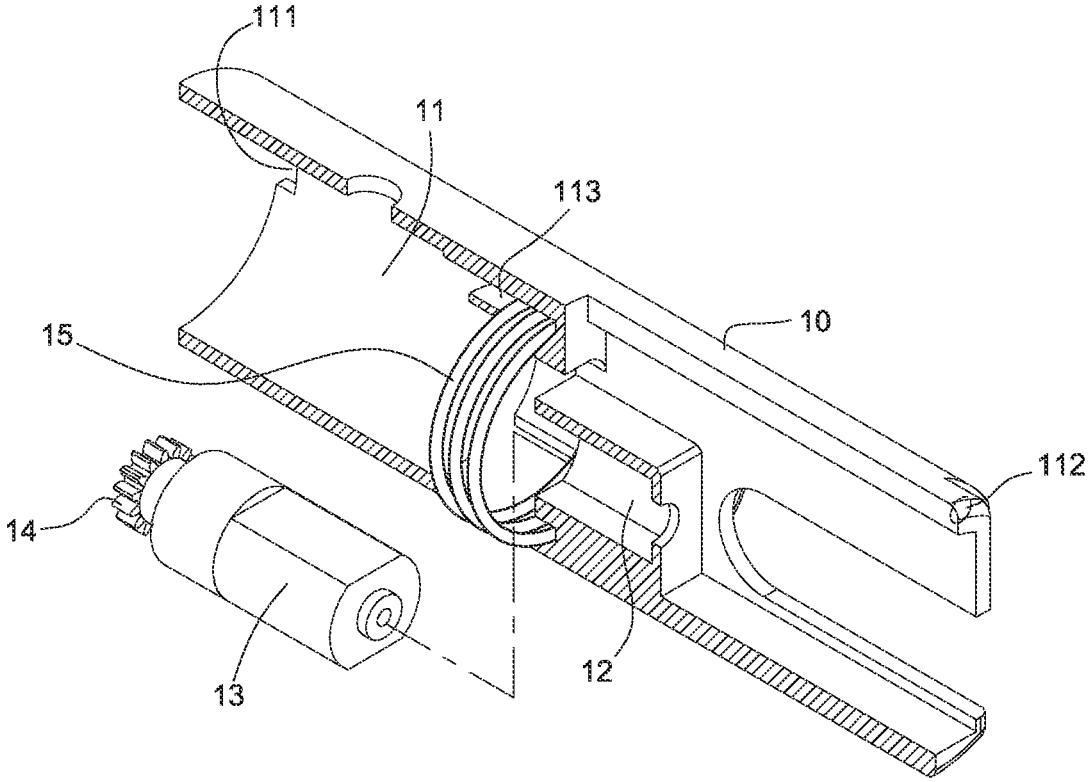
FIG. 8 is a cross-sectional perspective view showing the operation of the control structure of the door lock according to the preferred embodiment of the present invention.
Figure 9:
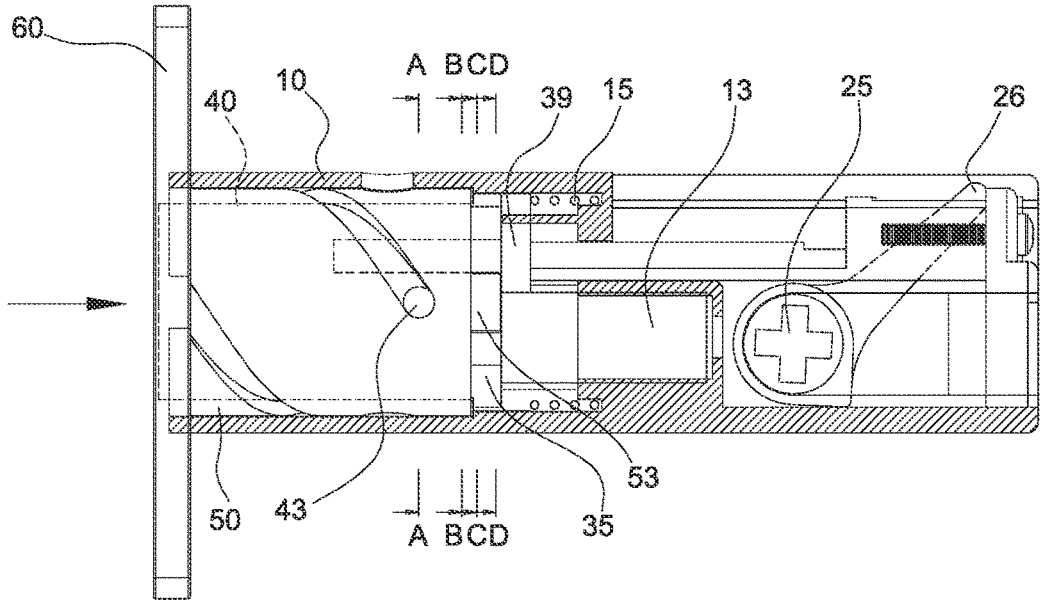
FIG. 9 is a cross sectional view showing the assembly of the control structure of the door lock according to the preferred embodiment of the present invention.
Figure 10:
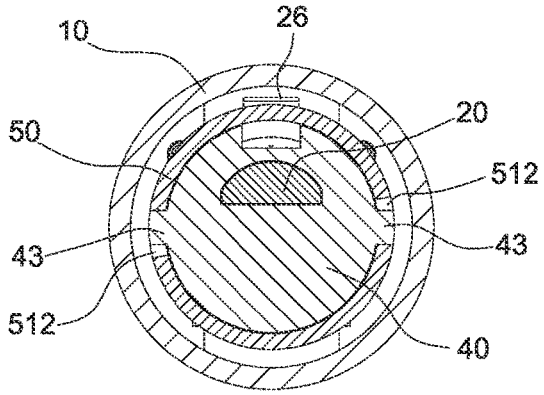
FIG. 10 is a cross sectional view taken along the line A-A of FIG. 9.
Figure 11:
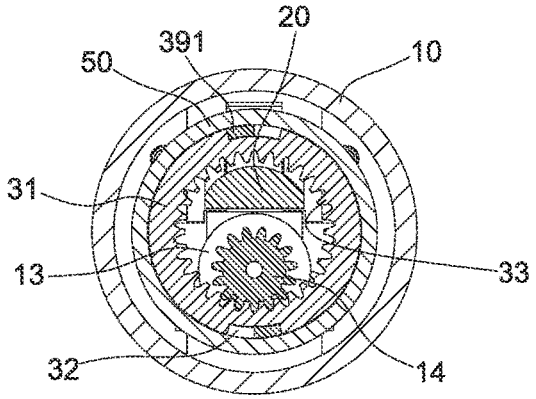
FIG. 11 is a cross sectional view taken along the line B-B of FIG. 9.
Figure 12:
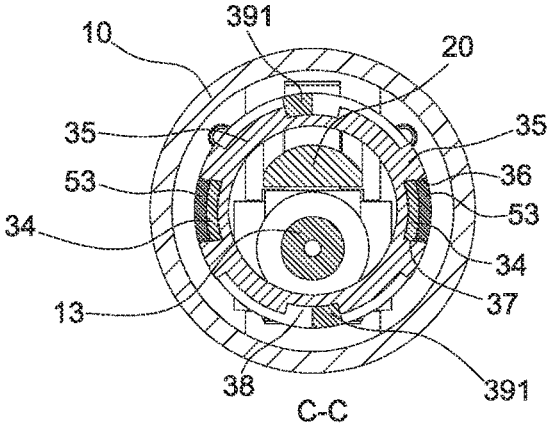
FIG. 12 is a cross sectional view taken along the line C-C of FIG. 9.
Figure 13:
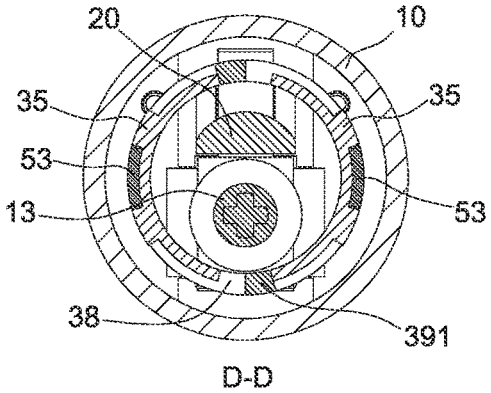
FIG. 13 is a cross sectional view taken along the line D-D of FIG. 9.
Figure 14:
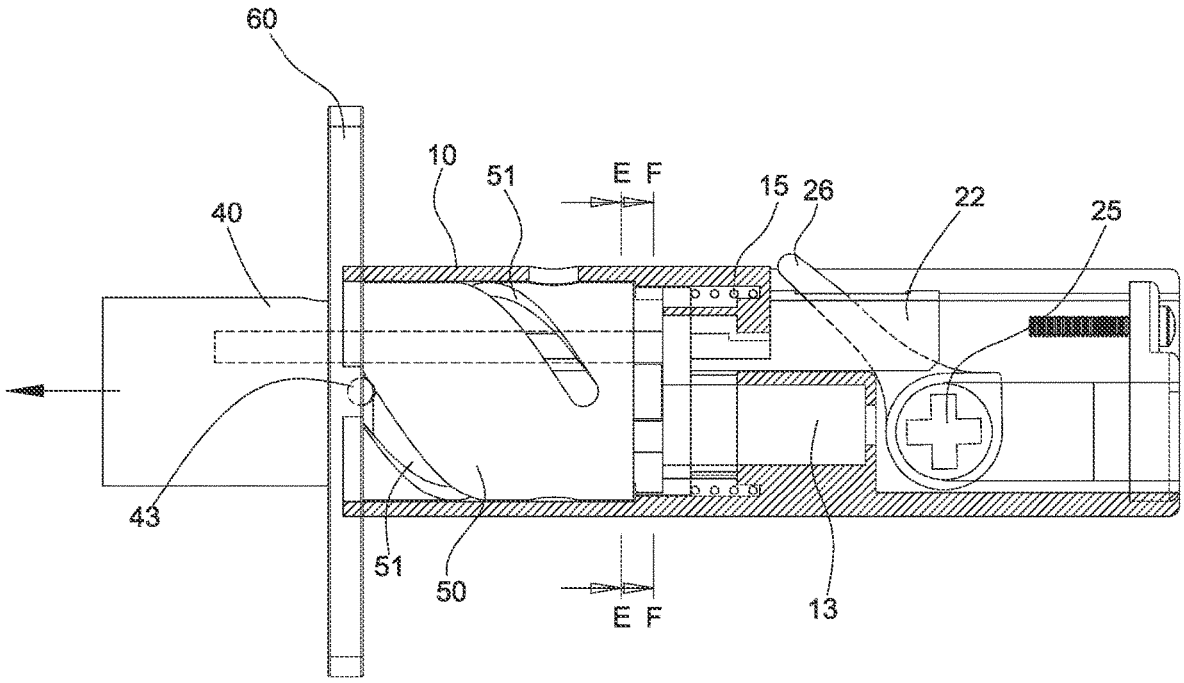
FIG. 14 is a cross sectional view showing the operation of the control structure of the door lock according to the preferred embodiment of the present invention.
Figure 15:
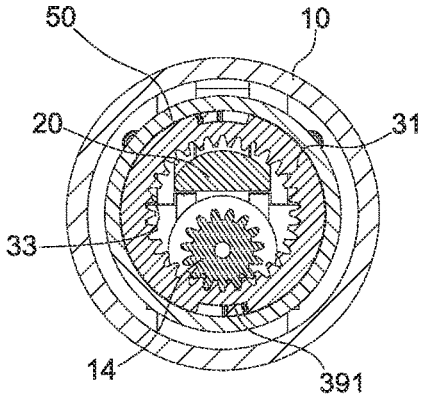
FIG. 15 is a cross sectional view taken along the line E-E of FIG. 14.
Figure 16:
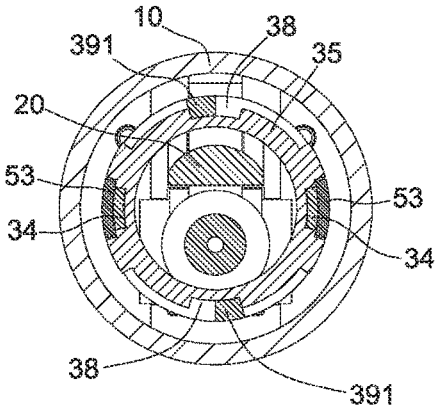
FIG. 16 is a cross sectional view taken along the line F-F of FIG. 14.

With reference to FIGS. 1-16, a control structure of a door lock according to a preferred embodiment of the present invention comprises a body 10 including a chamber 11 defined in the body 10, a receiving groove 12 formed in the chamber 11, a motor 13 partially accommodated in the receiving groove 12, a drive gear 14 fixed on a front end of the drive motor 13, a trench 113 defined on a predetermined position of the body 10 and corresponding to the receiving groove 12, a resilient element 15 retained in the trench 113; wherein the body 10 further includes a cap 16 mounted on a rear end of the body 10, two locking orifices 18 defined on two sides of the cap 16, two screw bolts 19 screwed with the two locking orifices 18, two threaded orifices 112 formed on the body 10 and corresponding to the two locking orifices 18 so that the two screw bolts 19 are screwed with the two threaded orifices 112 and the two locking orifices 18, and a guide slot 17 defined on a top of the cap 16 and configured to guide a holder 22 of a slide plate 20;

the slide plate 20 accommodated in the body 10 and including the holder 22 formed on a first end of the slide plate 20, a trough 23 defined on the holder 22 and configured to receive a rotation element 24, a lever 26 extending from a top of the rotation element 24, received in the trough 23, and configured to drive the slide plate 20 to move with respect to the body 10, a lock cylinder 25 extending from the rotation element 24 into the body 10, and a first connection orifice 21 defined on a second end of the slide plate 20;

a clutch assembly 30 being hollow, received in the slide plate 20 and located beside the motor 13, the clutch assembly 30 including a first annular ring 31, a second annular ring 35, and a third annular ring 39, wherein the first annular ring 31 has two notches 32 defined on a top and a bottom thereof, two wings 34 extending from two sides of the first annular ring 31 to the second annular ring 35, a toothed portion 33 formed around an inner wall of the first annular ring 31 and meshing with the drive gear 14 of the motor 13;

the second annular ring 35 located beside the first annular ring 31, and the second annular ring 35 including two first cutouts 38 defined on a top and a bottom of the second annular ring 35, two second cutouts 36 formed on two sides of the second annular ring 35, two recessed portions 37 defined on the second cutouts 36 and facing the first annular ring 35 so as to engage with the two wings 34;

the third annular ring 39 located beside the second annular element 35 and abutting against the resilient element 15, the third annular ring 39 including two actuation portions 391 extending to the second annular element 35 and engaged with the two first cutouts 38 of the second annular ring 35 and the first annular ring 31;

a head 40 including a defining groove 41 formed on a side of the head 40, a second connection orifice 42 communicating with the defining groove 41 and configured to partially receive the first end of the slide plate 20, wherein the second connection orifice 42 is aligned with the first connection orifice 21 so that a coupling element 27 is screwed with the first connection orifice 21 and the second connection orifice 42 to fix the head 40 on the first end of slide plate 20, wherein the head 40 further includes two bosses 43 formed on two predetermined positions of an outer wall thereof;

a guider 50 rotatably fixed in the chamber 11 of the body 10 and includes a space 54 defined in the guider 50 so as to guide the head 40 to move into or remove from the guider 50, at least two spiral indentations 51 formed on an outer wall of the guider 50, wherein a respective spiral indentation 51 has a first positioning segment 511 and a second positioning segment 512 and is in communication with the space 54, wherein the two spiral indentations 51 are configured to movably engage with the two bosses 43, such that when the head 40 moves forward or backward, the two bosses 43 drive the two spiral indentations 51 of the guider 50 to rotate clockwise or counterclockwise, and the guider 50 further includes two extensions 53 engaged with the two recessed portions 37 of the second annular ring 35; wherein the body 10 further includes two retainers 111 formed on the front end thereof and configured to engage with two engagement portions 62 of a stop sheet 60, and the stop sheet 60 includes an accommodation aperture 61 in which the head 40 moves. When the door lock is unlocked manually, the lock cylinder 25 is rotated to drive the lever 26 to actuate the trough 26 so that the slide plate 20 drives the head 40 to move backward, and the two bosses 43 actuate the two spiral indentations 51 of the guider 50 to rotate clockwise from the first positioning segment 511 to the second positioning segment 512, in the meantime, the two extensions 53 drive the second cutouts 36 of the second annular ring 35 to revolve, and the two first cutouts 38 of the second annular ring 35 drive the two actuation portions 391 of the third annular ring 39 and the two notches 32 of the first annular ring 31 to rotate clockwise. Since the third annular ring 39 abuts against the resilient element 15, the head 40 moves into the space 54 of the guider 50 when the third annular ring 39 rotates to press the resilient element 15 to revolve, thus unlocking the door lock. As desiring to lock the door lock manually, the clutch assembly 30 is pushed by the resilient element 15 to move back to an original position so that the second cutouts 36 of the second annular ring 35 actuate the two extensions 53 of the guider 50 to rotate counterclockwise, and the two bosses 43 of the head 40 are actuated by the two spiral indentations 51 of the guider 50 to revolve so that the head 40 moves into the two locking orifices 18 from the space 54, thus locking the door lock.

When desiring to unlock the door lock electrically, the motor 13 is driven by the drive gear 14 to actuate the toothed portion 33 of the first annular ring 31 to rotate clockwise, and the two wings 34 of the first annular ring 31 drive the two recessed portions 37 of the second annular ring 35 to rotate the second annular ring 35 clockwise, wherein the second cutouts 36 actuate the guider 50 and the two extensions 53 to revolve clockwise. When the guider 50 rotates clockwise, the two spiral indentations 51 of the guider 50 drive the two bosses 43 of the head 40 to move into the second positioning segment 512 from the first positioning segment 511, in the meantime, the head 40 moves into the space 54 of the guider 50, thus unlocking the door lock. When locking the door lock electrically, the motor 13 is driven by the drive gear 14 to actuate the toothed portion 33 of the first annular ring 31 to revolve counterclockwise, and the two wings 34 of the first annular ring 31 drive the two recessed portions 37 of the second annular ring 35 to rotate the second annular ring 35 counterclockwise, such that the second cutouts 36 of the second annular 35 actuate the guider 50 and the two extensions 53 to revolve counterclockwise. When the guider 50 revolves counterclockwise, the two spiral indentations 51 of the guider 50 drive the two bosses 43 of the head 40 to move into the first positioning segment 511 from the second positioning segment 512, and the head 40 moves into the two locking orifices 18 from the space 54, thus locking the door lock.

Thereby, the control structure of the door lock actuates the head 40 to extend outward or retract inward to lock or unlock the two screw bolts 19 by way of the guider 50, the clutch assembly 30, and the resilient element 15. Preferably, the body 10 is one-piece formed to accommodate the head 40 securely and to avoid deformation of the two screw bolts 19.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A control structure of a door lock comprising:

a body including a chamber defined in the body, a receiving groove formed in the chamber, a motor partially accommodated in the receiving groove, a drive gear fixed on a front end of the motor, a trench defined within the chamber of the body and corresponding to the receiving groove, and a resilient element retained in the trench;

a slide plate accommodated in the body and including a holder formed on a first end of the slide plate, a trough defined on the holder and configured to receive a rotation element, a lever extending from a top of the rotation element, received in the trough, and configured to drive the slide plate to move with respect to the body, a lock cylinder extending from the rotation element into the body, and a first connection orifice defined on a second end of the slide plate;

a clutch assembly being hollow and located beside the motor, and the slide plate passes through the clutch assembly, the clutch assembly including a first annular ring, a second annular ring, and a third annular ring, wherein the first annular ring has two notches defined on a top and a bottom thereof, two wings extending from two sides of the first annular ring to the second annular ring, a toothed portion formed around an inner wall of the first annular ring and meshing with the drive gear of the motor;

the second annular ring being located beside the first annular ring, and the second annular ring including two first cutouts defined on a top and a bottom of the second annular ring, two second cutouts formed on two sides of the second annular ring, two recessed portions defined on the second cutouts and facing the first annular ring so as to engage with the two wings;

the third annular ring being located beside the second annular ring and abutting against the resilient element, the third annular ring including two actuation portions extending to the second annular ring and engaged with the two first cutouts of the second annular ring and the two notches of the first annular ring;

a head including a defining groove formed on a side of the head, a second connection orifice communicating with the defining groove and configured to partially receive the first end of the slide plate, wherein the second connection orifice is aligned with the first connection orifice so that a coupling element is screwed with the first connection orifice and the second connection orifice to fix the head on the first end of slide plate, wherein the head further includes two bosses formed on two predetermined positions of an outer wall thereof;

a guider rotatably fixed in the chamber of the body and includes a space defined in the guider so as to guide the head to move into or remove from the guider, at least two spiral indentations formed on an outer wall of the guider, wherein the at least two spiral indentations are in communication with the space and are configured to movably engage with the two bosses, such that when the head moves forward or backward, the two bosses drive the two spiral indentations of the guider to rotate clockwise or counterclockwise, and the guider further includes two extensions engaged with the two recessed portions of the second annular ring.

2. The control structure of the door lock as claimed in claim 1, wherein the body further includes a cap mounted on a rear end thereof, two locking orifices defined on two sides of the cap, two screw bolts screwed with the two locking orifices, and two threaded orifices formed on the body and corresponding to the two locking orifices so that the two screw bolts are screwed with the two threaded orifices and the two locking orifices, and a guide slot is defined on a top of the cap and configured to guide a holder of a slide plate.

3. The control structure of the door lock as claimed in claim 1, wherein the body further includes two retainers formed on the front end thereof and configured to engage with two engagement portions of a stop sheet, and the stop sheet includes an accommodation aperture in which the head moves.

* * * * *